US005473857A

United States Patent [19]

Keeler

[11] Patent Number: 5,473,857

[45] Date of Patent: Dec. 12, 1995

[54] SYSTEM INTEGRATION FOR HOT MELT SEALING OF FITMENTS IN-LINE WITH FORM/FILL/SEAL MACHINE

[75] Inventor: Donald E. Keeler, Sussex, N.J.

[73] Assignee: International Paper Company, Purchase, N.Y.

[21] Appl. No.: 153,518

[22] Filed: Nov. 16, 1993

[51] Int. Cl.[6] ..... B65B 61/18

[52] U.S. Cl. ..... 53/410; 53/133.2; 156/69

[58] Field of Search ..... 53/133.2, 133.1, 53/410, 306, 485; 156/69

[56] References Cited

U.S. PATENT DOCUMENTS

| | | | |
|---|---|---|---|
| 2,850,042 | 9/1956 | Welch | 156/274.4 |
| 3,629,989 | 12/1971 | Reinecke | 53/306 |
| 4,246,062 | 1/1981 | Christine | 53/410 |
| 4,512,136 | 4/1985 | Christine | 53/410 |
| 4,718,215 | 1/1988 | Carveth et al. | 53/410 |
| 4,846,915 | 7/1989 | Keeler et al. | 156/261 |
| 4,925,034 | 5/1990 | Robichaud et al. | 220/267 |
| 4,930,683 | 6/1990 | Farber | 220/258 |
| 4,990,200 | 2/1991 | Heinz | 53/485 |
| 5,058,360 | 10/1991 | Yamazaki | 53/133.2 |
| 5,069,385 | 12/1991 | Farber | 220/288 |
| 5,100,369 | 3/1992 | Keeler | 493/87 |
| 5,101,999 | 4/1992 | Robichaud et al. | 220/258 |
| 5,102,485 | 4/1992 | Keeler et al. | 156/256 |
| 5,110,041 | 5/1992 | Keeler | 229/125.15 |
| 5,150,559 | 9/1992 | Winfield | 53/133.2 |
| 5,267,934 | 12/1993 | Pape | 53/133.2 |

*Primary Examiner*—Daniel C. Crane
*Attorney, Agent, or Firm*—Ostrager, Chong & Flaherty

[57] ABSTRACT

A fitment application apparatus, for applying plastic spout fitments to filled and sealed cartons, is integrated in line with a conventional form/fill/seal production line. The fitment application apparatus includes a conveyor for intermittently advancing each one in a series of formed, filled and sealed cartons in turn to a fitment application station. A hopper and associated gravity-feed track supply a series of fitments to a fitment applicator anvil. Each fitment has a flange portion, the bottom surface of which is coated with hot melt adhesive as the fitment slides past a hot melt adhesive applicator roll. A fitment retaining mechanism receives and positions each fitment such that the flange bottom surface coated with hot melt adhesive faces an external side of the wall of the filled carton. The fitment applicator anvil intermittently carries fitments from the fitment retaining mechanism into abutting relationship with the filled carton in registration with the spout hole, thereby pressing the flange bottom surface coated with hot melt adhesive against the extrusion layer on the external side of the carton wall, whereby the fitment is applied to the filled and sealed carton.

18 Claims, 4 Drawing Sheets

SYSTEM INTEGRATION FOR HOT MELT SEALING OF FITMENTS IN-LINE WITH FORM/FILL/SEAL MACHINE

FIELD OF THE INVENTION

This invention generally relates to an apparatus and a method for applying fitments on paperboard cartons. In particular, the invention is of the type which can be used for operation in-line with conventional carton form/fill/seal machinery.

BACKGROUND OF THE INVENTION

Conventional paperboard cartons for packaging milk, juice, and other beverage products are typically formed from a paperboard blank assembled in a rectangular open-ended configuration, which is then filled with the liquid contents and sealed with a gable or flat-folded top. The carton forming, filling, and sealing is done under sanitary conditions in lines of "form/fill/seal" machinery. The industry has developed reclosable spouts for such cartons, typically in the form of plastic spout fitments which are sealed to the top end of the cartons. Examples of hinged-type spout fitments are shown in commonly owned U.S. Pat. Nos. 4,705,197 and 4,770,325, both to Gordon and Kalberer. Other types of spout fitments include pull-open nozzles and screw caps. These reclosable spouts allow the cartons to be more easily opened and reclosed without leaking.

The plastic spout fitments are typically attached to the paperboard blanks by sealing a flange portion of the fitment to a heat-sealable coating or extrusion layer on the paperboard, by means of adhesives, heat sealing, or sealing with an ultrasonic horn. The attachment step requires an intermittent certain dwell time for aligning each fitment in position on a carton and applying the required adhesive, heat or ultrasonic energy to the portion to be sealed. An example of indexing machinery for precise registration and sealing of fitments to cartons is shown in commonly owned U.S. Pat. No. 4,846,915 of Keeler et al.

As reclosable spout fitments have come into widespread use, recent developments have been made in fitment sealing apparatus which synchronize the intermittent fitment sealing step with a continuous conveyor line used to supply cartons to form/fill/seal machinery. Examples of such fitment sealing apparatus are shown in commonly owned U.S. Pat. No. 5,102,485 of Keeler and Bombolevich and U.S. Pat. No. 5,100,369 of Keeler. In these examples, the fitments are formed with a flat shape and are supplied to the fitment sealing station from a web or roll.

It is also desirable to apply three-dimensionally shaped spouts, e.g. plastic pull-open nozzles or screw caps, to the cartons at high speed in order to supply a continuous line of fitted cartons to a form/fill/seal machine. One proposal for such an apparatus is shown in U.S. Pat. No. 4,788,811 of Kawajiri et al. This sealing apparatus includes a suction holder which retrieves a three-dimensional cap fitment from the end of a supply chute, moves the fitment axially inside a carton blank assembled in rectangular tube configuration, inserts the spout portion of the fitment laterally through a hole die-cut in the carton wall, and holds the flange portion of the fitment against the heat-sealable coating on the internal side of the carton while an ultrasonic horn is advanced on the external side. This apparatus, however, has the problem that the complex movements required of the cap holder limit the speed at which the machinery can be operated and, further, has a significant risk of mechanical breakdown or misalignment of the fitment.

U.S. Pat. Nos. 4,246,062 and 4,512,136 to Christine disclose apparatus for attaching a fitment to a pouch.

Finally, commonly owned U.S. Pat. No. 5,110,041 to Keeler discloses an apparatus for attaching spout fitments to carton blanks which is integrated in line with conventional form/fill/seal production lines. The spout fitments are attached before the carton blanks are formed, filled and sealed. In accordance with this teaching, dual fitment sealing stations are arranged in line with respective form/fill/seal production lines. Each line requires a continuous input of cartons from the respective station ready to be formed with a bottom end, filled with liquid contents, and sealed at the top end. Each fitment sealing station includes: a carton supply for supplying a series of carton blanks in rectangular tube form, each having the spout hole cut through the carton wall at a selected spout position in the vicinity of the open top end; an indexing conveyor for intermittently advancing the carton blanks in turn to a sealing station; a fitment supply track for supplying a series of fitments to the sealing station through an escapement gate; a fitment retaining mechanism for receiving the fitment released from the escapement gate and positioning it in registration with the spout hole in the carton blank at the sealing station; an anvil movable into the open top end inside the carton adjacent the spout hole position; and a sealing head which is moved to press the fitment in contact with the extrusion layer on the carton wall and against the anvil inside the carton blank. A further support member may be provided between the sealing stations of the two lines to absorb the offsetting impacts of the sealing heads. From the sealing station, the carton fitted with the spout fitment is advanced by the indexing conveyor to an output end where the carton blanks are transferred to the form/fill/seal line. In accordance with one preferred embodiment, the fitments are attached to the carton by application of hot melt adhesive.

SUMMARY OF THE INVENTION

It is a principal object of the invention to provide an apparatus and a method for sealing plastic spout fitments to paperboard cartons in a continuous mode of operation which improves upon the prior art. In particular, it is an object of the invention to provide an apparatus and a method for sealing plastic spout fitments on formed, filled and sealed cartons received in a continuous line from a form/fill/seal machine.

A further object of the invention is to provide a low-cost means for retrofitting a conventional form/fill/seal production line with a mechanism for applying spout fitments which is modular in design.

Another object of the invention is to provide an apparatus and a method capable of applying three-dimensional spout fitments on cartons with a high degree of precision and efficiency, e.g., to within ±0.005 inch.

Yet another object of the invention is to provide an apparatus and a method for sealing plastic spout fitments on cartons in alignment with die-cut opening having an extruded layer of thermoplastic material overlying the void.

It is a further object that such apparatus be constructed so that the moving elements thereof execute limited mechanical movements and/or functions, in order to assure a high degree of reliability and reduce the risk of mechanical failure.

A further object of the invention is to provide an apparatus and a method for sealing plastic spout fitments on filled gable-top or flat-top liquid containers wherein 100% of the area of the fitment flange is sealed to the carton.

Another object of the invention is to provide apparatus suitable for sealing plastic spout fitments on filled gable-top or flat-top liquid containers in quart, one-liter, half-gallon and two-liter sizes.

In accordance with the invention, a fitment-sealing apparatus, for sealing plastic spout fitments to filled cartons, is integrated in line with a conventional form/fill/seal production line. Each apparatus includes a conveyor for intermittently advancing formed, filled and sealed cartons in turn to a fitment application station. A hopper and associated gravity-feed track supply a series of fitments to a fitment applicator anvil. Each fitment has a flange portion, the bottom surface of which is coated with hot melt adhesive as the fitment slides past a hot melt adhesive applicator roll. A fitment retaining mechanism receives and positions each fitment so that the adhesive-coated surface faces an external side of a wall of each filled carton. A fitment applicator anvil intermittently carries fitments from the fitment retaining mechanism into abutting relationship with the filled carton in registration with the spout hole, thereby pressing the adhesive-coated surface of the fitment against the external surface of the carton wall. As a result, the fitment is sealed to an external surface of a sealed carton filled with liquid or pourable solid matter.

DETAILED DESCRIPTION OF INVENTION

The present invention has application for cartons having a spout hole cut through the carton wall at a selected spout position in the top end of the carton, which spout hole is sealed by an extruded layer of thermoplastic material. After the carton has been formed, filled and sealed on a conventional form/fill/seal production line, the spout fitment is attached, using hot melt adhesive, to the external surface of an annular wall portion surrounding the spout hole.

Figure 5:
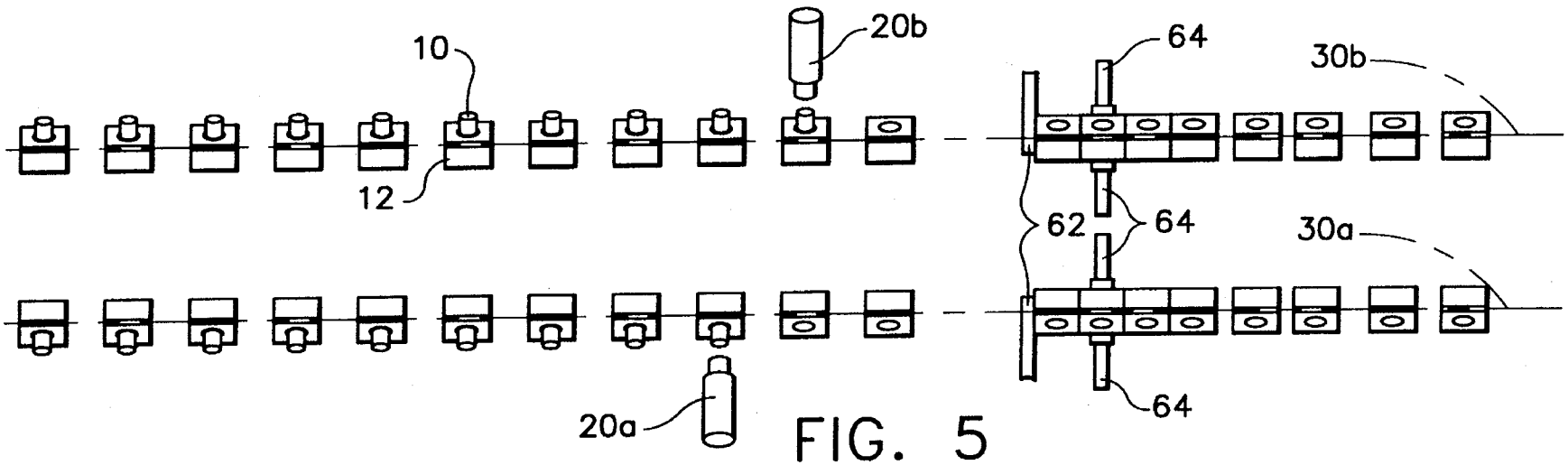
FIG. 5 is a schematic diagram showing the feeding of filled gable-top cartons from dual form/fill/seal production lines to dual fitment application stations in accordance with the invention.
Figure 6:
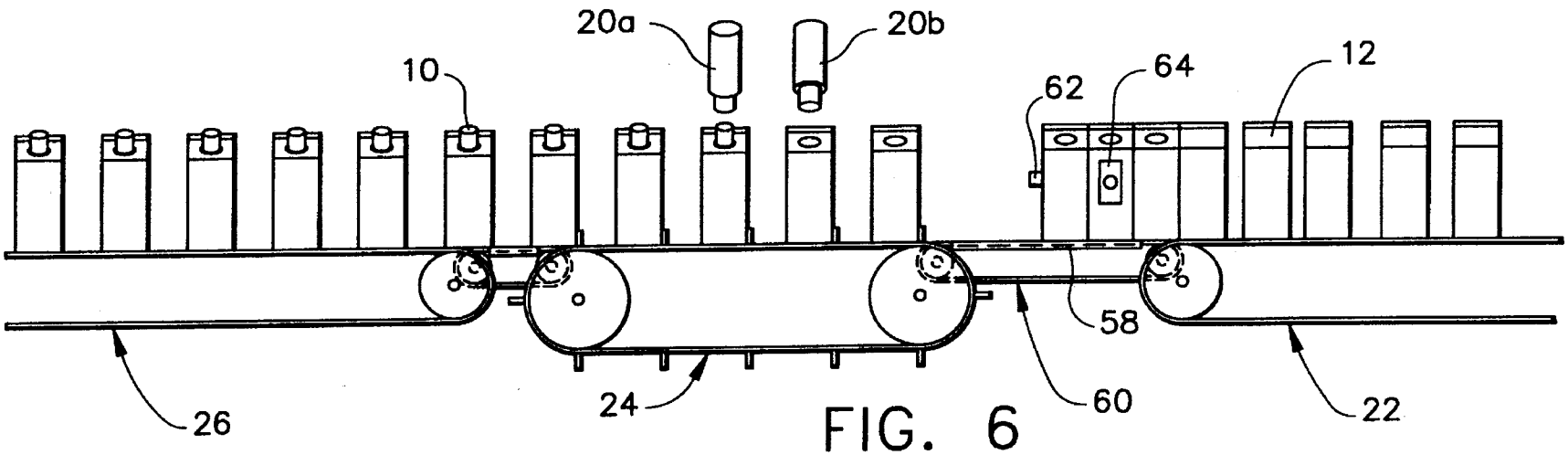
FIG. 6 is a side view of one of the form/fill/seal production lines shown in FIG. 5.

Referring to FIGS. 5 and 6, dual fitment application stations 20*a*, 20*b* are shown in line with respective form/fill/seal production lines 30*a*, 30*b*. Each line requires a continuous input of cartons ready to be formed with a bottom end, filled with liquid contents, and sealed at the top end. The general construction and operation of a form/fill/seal machine for high-speed production of liquid-container products are well known in the industry and are not described further herein. The form/fill/seal lines preferably operate in the range of 40 to 60 sealing operations per minute.

As depicted in FIG. 6, the filled and sealed cartons 12 are carried from the end of the form/fill/seal production line by a continuous line conveyor 22. The cartons riding on conveyor 22 are spaced at equal intervals. Each successive carton is deposited in turn on the end of a dead plate 58 arranged between and parallel to a pair of continuous line conveyors 60. During continuous operation, the cartons standing on dead plate 58 are urged forward by conveyors 60 which contact the bottoms of the cartons on respective sides of the dead plate. Conveyors 60 carry each carton forward until it collides with the last carton of a stacked-up line of abutting cartons being held stationary by an escapement 62 in a closed position. Side clamping means 64 are provided for intermittently clamping the second carton of the stacked-up line of abutting cartons in a stationary position.

The escapement 62 is actuated to release the first carton of the stacked-up line of abutting cartons during a portion of the timing cycle when side clamping means 64 hold the second carton stationary. During that interval, conveyors 60 carry the first carton in the stacked-up line toward the fitment application station 20*a*. After the first carton has been released, escapement 62 is returned to the closed position. At a predetermined time relative to the closing of escapement 62, the side clamping means 64 are actuated to open, thereby releasing the remaining cartons of the stacked-up line of cartons. These stacked-up cartons are then advanced one place by conveyors 60 until the first carton in the stack is stopped by escapement 62 in the closed position. Immediately thereafter, the side clamping means 64 are closed to hold the new second carton in place. This sequence of steps is repeated in accordance with a predetermined timing cycle so that successive filled and sealed cartons are carried by continuous conveyors 60 toward the fitment application stations and onto an indexing flight conveyor 24 with appropriate timing.

Each carton carried by conveyors 60 is tranferred to indexing flight conveyor 24 while the latter is moving. The indexing flight conveyor is stopped intermittently to allow a fitment 10 to be sealed to the carton 12 standing underneath the fitment application station 20*a*. After each sealing operation, the cartons on the indexing flight conveyor 24 are moved forward one place, with the leading carton being deposited on a continuous delivery conveyor 26.

The line for fitment application station 20*b* has the same structure, except that fitment application station 20*b* is offset from fitment application station 20*a* to provide clearance.

Figure 1B:
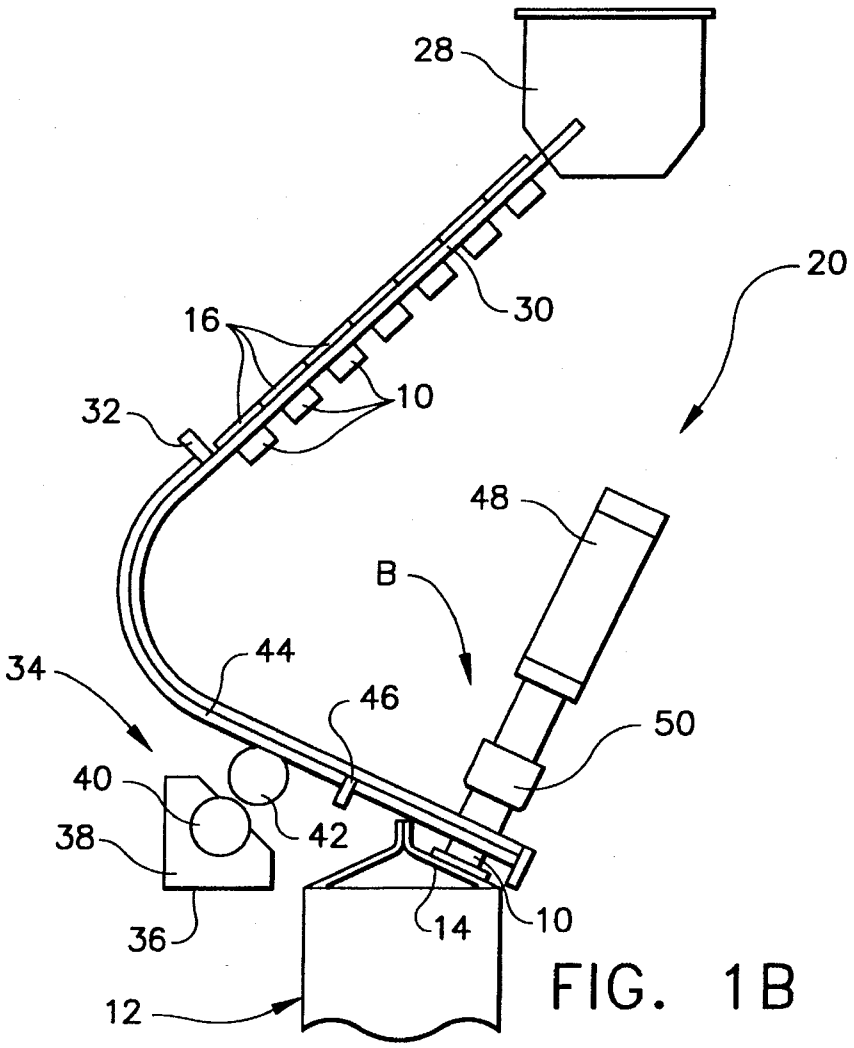
FIGS. 1A and 1B are rear views of the fitment application station in accordance with the preferred embodiment of the invention for use with gable-top cartons, with the fitment sealing head in the advanced and retracted positions respectively.
Figure 1A:
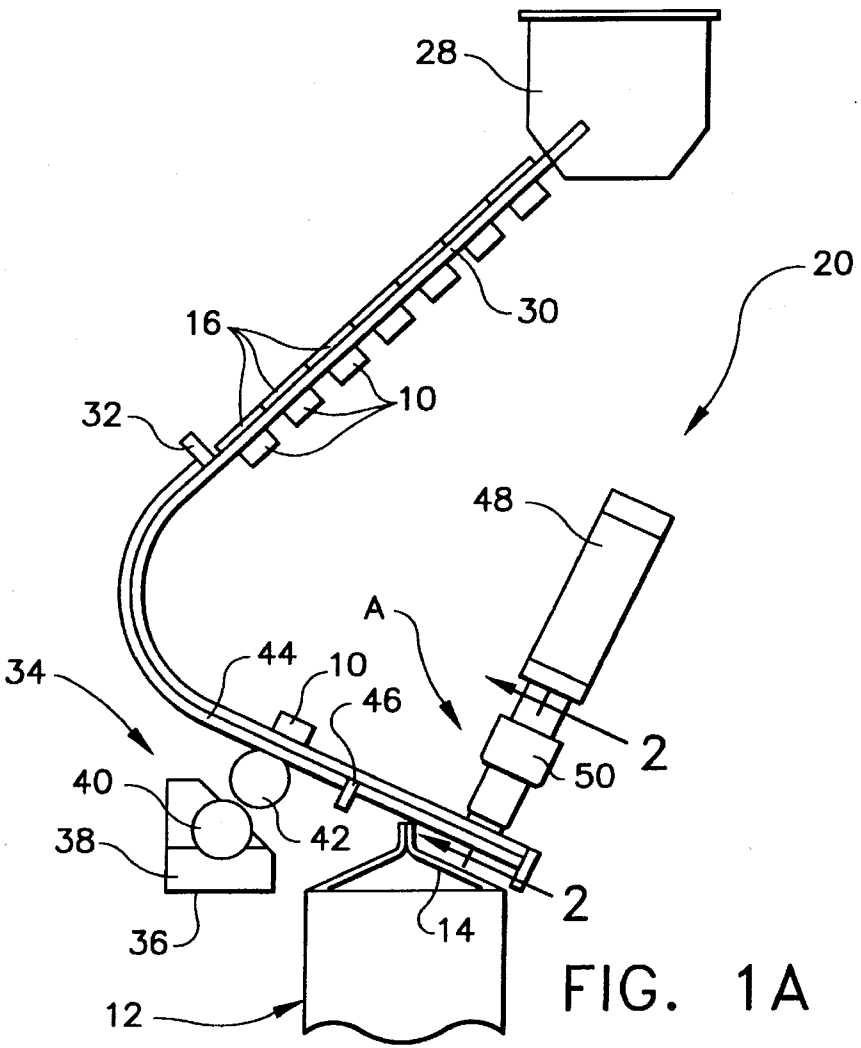

The apparatus for sealing fitments on gable-top cartons is shown in FIGS. 1A, 1B, 2 and 3. Referring to FIG. 1A, spout fitments 10 are fed automatically from a vibratory hopper 28 to a gravity feed conveyor 30. An escapement 32 is arranged on the gravity feed conveyor to have open and closed positions. In the closed position, escapement 32 prevents the fitments from sliding down the conveyor. Escapement 32 releases one fitment per cycle. A second gravity feed conveyor 44 is connected to gravity feed conveyor 30 and extends downstream of escapement 32. Gravity feed conveyor 44 has opposing guideways 56 (see FIG. 2) for guiding opposing edges of the spout fitment flange 16. As the released fitment slides down gravity feed conveyor 44, it changes its orientation by more than 90 degrees due to the curvature of conveyor 44.

Means 34 for applying hot melt adhesive on the under side of the fitment flange 16 are arranged beneath conveyor 44. The hot melt adhesive applying means 34 comprise a heated reservoir 36 filled with pressure-sensitive hot melt adhesive 38, a melt distribution roll 40 which dips into the hot melt adhesive, and a hot melt applicator roll 42 in revolving contact with melt distribution roll 40. As each fitment 10 travels down the straight inclined portion of conveyor 44, hot melt applicator roll 40 brushes hot melt adhesive on the under side of fitment flange 16. The freshly coated fitment is stopped by an escapement 46 before it reaches a position in registration with the spout hole on the carton.

Escapement 46 is also opened to release one fitment per cycle. The released fitment with adhesive thereon travels down conveyor 44 to a location directly in front of the die-cut opening in the gable top 14 of the carton 12 standing below fitment application station 20. In this position, the fitment is received in a recess 18 formed in a fitment applicator anvil 50 which is slidably coupled to a fitment applicator cylinder 48 (see FIG. 3).

Recess 18 has a planar ceiling 52. Two or more ducts 54 communicate with recess 18 in the plane of ceiling 52. Ducts 54 are connected to a reversible vacuum blower (not shown), which can be operated to either evacuate air from or blow air into ducts 54. When ducts 54 are evacuated, the resulting vacuum serves to hold the fitment flush against planar ceiling 52. When air is blown into ducts 54, the fitment is disengaged from the anvil.

Figure 2:
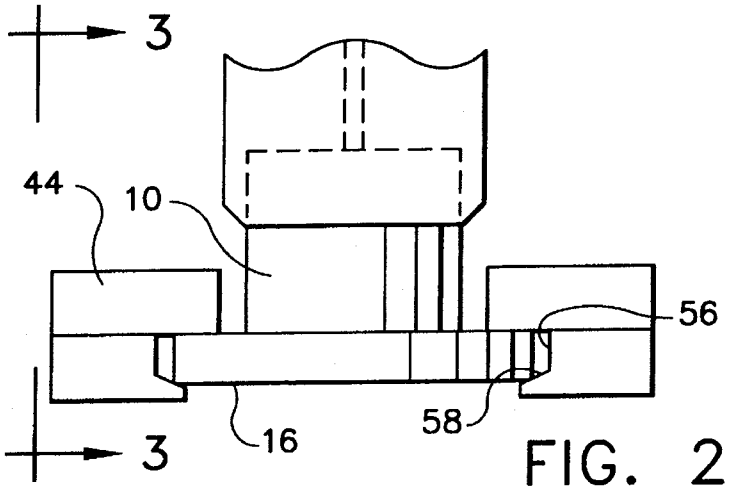
FIG. 2 is an end view of the fitment retaining mechanism in accordance with the preferred embodiment of the invention, taken from the direction indicated by arrows 2 shown in FIG. 1A.
Figure 3:
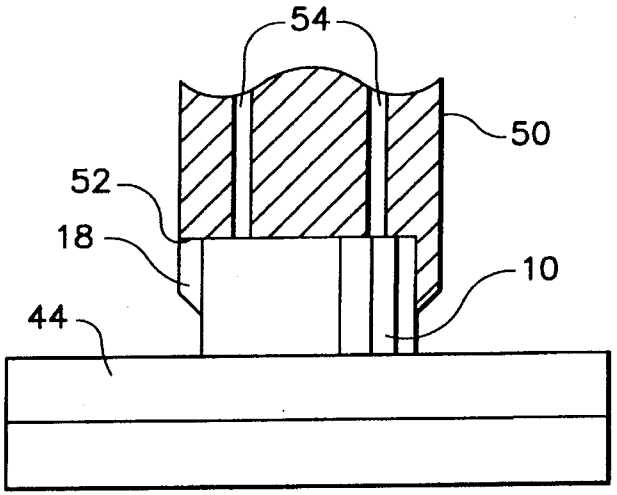
FIG. 3 is a sectional view of the fitment retaining mechanism taken along section 3—3 shown in FIG. 2.

The fitment applicator anvil 50 is alternately advanced and retracted by energization and de-energization of cylinder 48. The retracted position is designated by letter "A" in FIG. 1A; the advanced position is designated by letter "B" in FIG. 1B. In the retracted position, the fitment flange is seated in opposing guideways 56 of conveyor 44. The anvil 50 is advanced while the fitment is being held in place by the vacuum in ducts 54. As shown in FIG. 2, the guideways 56 which retain the plastic fitments in proper position have terminal portions with inclined lower surfaces 58 in the vicinity of the fitment applicator anvil. These inclined surfaces allow the flexible flange 16 of the plastic fitment 10 to be easily popped out of the guideways during the initial stage of the anvil's advancement. The vacuum in ducts 54 ensures that the fitment does not become misaligned or fall out of the anvil as the fitment is popped out of the gravity feed conveyor 44 and carried toward the gable-top carton 12.

Figure 7:
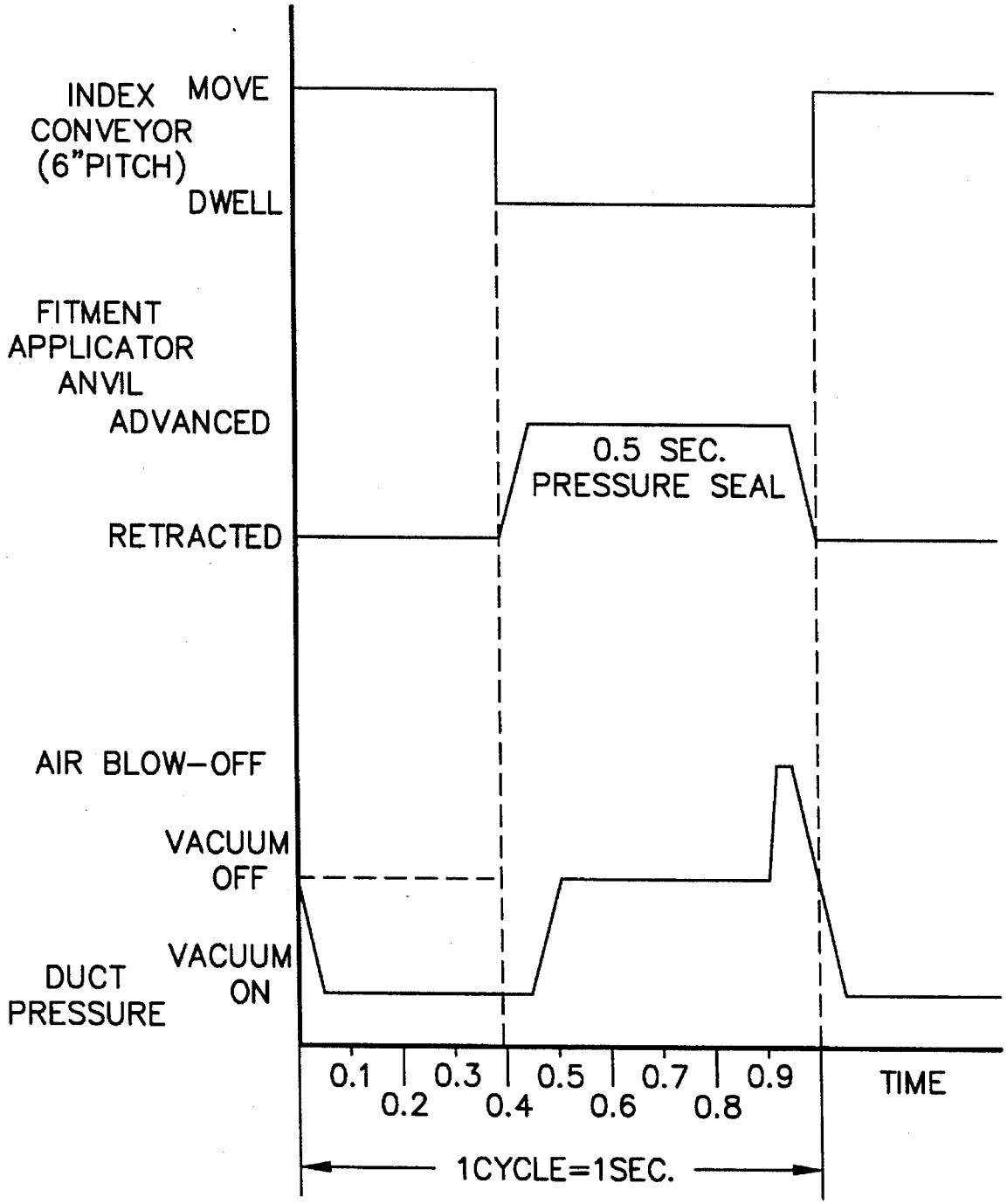
FIG. 7 is a timing chart showing the timing relationships for the index conveyor and the fitment applicator anvil in accordance with the preferred embodiments of the invention.

As seen in FIG. 7, the vacuum is turned off as soon as the anvil reaches the advanced position, at which point the fitment is pressed against the external wall of the gable-top carton by the anvil and need no longer be held in place by the vacuum. The fitment is placed directly over the die-cut (extrusion over void area). The pressure is applied by the anvil 50 for about 0.5 sec or any other time period sufficient to activate the particular pressure-sensitive adhesive being used.

Before the applicator anvil 50 is retracted, air is blown into ducts 54 under pressure (see FIG. 7) by the reversed vacuum blower. This ensures that the anvil does not carry the fitment back to the retracted position. Following air blow-off, the anvil returns to the retracted position, at which time the fitment application station is ready for the next cycle and ducts 54 are again evacuated.

From the fitment application station 20, the carton fitted with a spout fitment is advanced by the indexing conveyor 22 to an output end, where the filled and sealed cartons are transferred to a delivery conveyor 26 (see FIG. 6).

Figure 4:
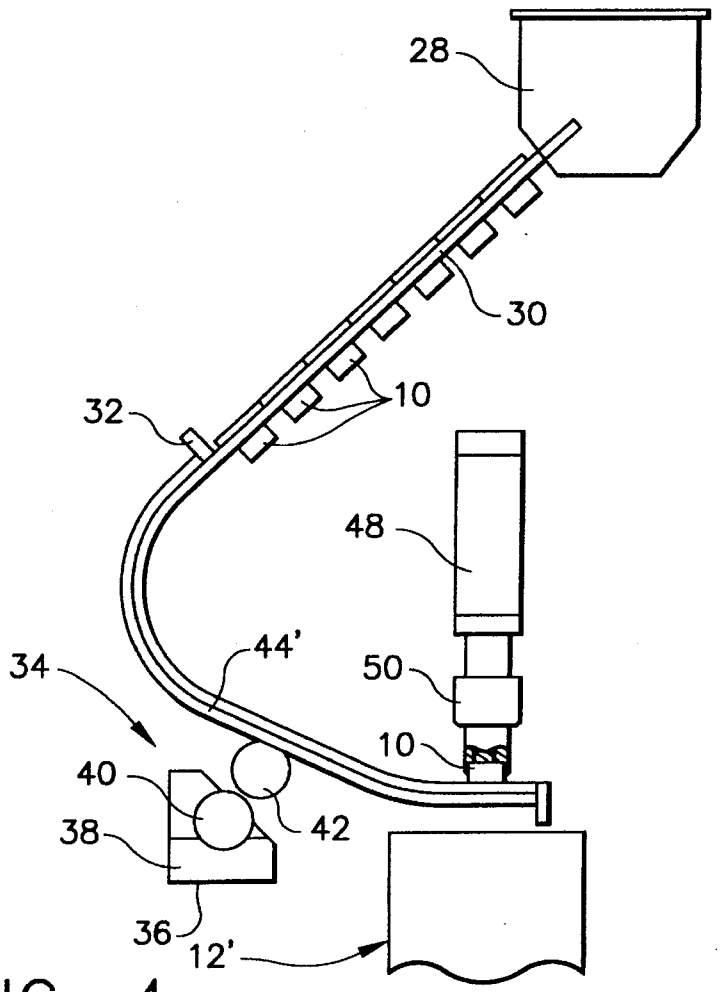
FIG. 4 is a rear view of the fitment application station in accordance with the preferred embodiment of the invention for use with flat-top cartons, with the fitment sealing head in the retracted position.

The invention also has application to flat-top containers 12', as shown in FIG. 4. The main difference between the respective fitment application stations for gable-top and flat-top cartons lies in the orientation of the terminal portions of the respective gravity feed conveyors. Conveyor 44', shown in FIG. 4, has a terminal portion which is generally horizontal, i.e., parallel to the top of the flat-top carton 12'. Components bearing the same reference numerals in FIGS. 1A and 4 have substantially identical structures, the description of which will not be repeated here.

In accordance with the invention, the sealing of spout fitments to the filled and sealed cartons can be achieved at a rate of 60 units/minute or higher, and dual lanes can be arranged side-by-side. The moving elements at the fitment application station execute simple mechanical movements so as not to limit an increase in production speed or present a risk of mechanical failure. Accurate registration of the fitment to the die-cut spout hole in the carton is obtained, and a secure seal can be formed with a low error rate. The fitment sealing system is simple in design and can be assembled at a low cost. Most importantly, the input of the fitment application station can be synchronized with the output of a conventional form/fill/seal production line for the supply of spout-fitted filled and sealed cartons with a minimum of retrofitting. The bonding of the fitment to the carton by means of a hot melt adhesive layer ensures a fitment seal of complete integrity and reliability.

Numerous modifications and variations will be apparent to practitioners of ordinary skill in the art of packaging given the above disclosure of the principles and best mode of carrying out the invention. It is intended that all such modifications and variations be considered as within the spirit and scope of the invention as defined in the following claims.

What is claimed is:

1. An apparatus for applying fitments on formed, filled and sealed cartons output in series by a conventional form/fill/seal machine, each of said cartons having a closed top end with a spout hole formed in its wall and an extrusion layer sealing said spout hole, comprising:

carton advancing means for intermittently advancing each of said formed, filled and sealed cartons in turn to a fitment application station;

fitment supply means for supplying a series of said fitments to said fitment application station, each of said fitments having a cap portion and a flexible flange portion;

hot melt adhesive application means for applying a hot melt adhesive material on a bottom surface of said flange portion of each of said fitments;

fitment retaining means for receiving each of said fitments supplied by said fitment supply means and positioning each of said fitments such that said bottom surface of said flange portion with said hot melt adhesive material applied thereon faces said extrusion layer sealing said spout hole in said wall of each of said cartons while each of said cartons are standing at said fitment application station; and fitment application means for carrying each of said fitments from said fitment retaining means into abutting relationship with an external side of said wall of each of said cartons such that said bottom surface of said flange portion of each of said fitments with said hot melt adhesive material applied thereon is pressed against said extrusion layer in registration with said spout hole, wherein said fitment retaining means comprises first and second fitment flange support means arranged in opposing relationship, each fitment flange support means having a guideway for cooperating with a peripheral edge of a corresponding diametral portion of said flange portion of each of said fitments retained thereby, and said guideway having an inclined surface which facilitates snapping of said flexible flange portion out of said guideway as said fitment application means carries each of said fitments toward said closed top end of each of said formed, filled and sealed cartons.

2. The apparatus as defined in claim 1, further comprising escapement means for intermittently releasing each of said fitments in turn from said fitment supply means.

3. The apparatus as defined in claim 1, further comprising timing control means for controlling said fitment application means and said carton advancing means such that said formed, filled and sealed cartons are advanced and then held stationary while said fitments are carried into abutting relationship therewith in alternating sequence.

4. The apparatus as defined in claim 1, further comprising means for alternately advancing and retracting said fitment application means respectively toward and away from said closed top end of each of said formed, filled and sealed cartons which are standing at said fitment application station.

5. The apparatus as defined in claim 4, wherein said fitment application means comprises means for releasing each of said fitments from said fitment application means prior to retraction of said fitment application means, and said carton advancing means advances each of said cartons fitted with one of said fitments from said application station after retraction of said fitment application means.

6. The apparatus as defined in claim 5, wherein said releasing means comprises duct means for carrying pressurized air toward said cap portion of said fitment during a first portion of a timing cycle to cause separation of said fitment from said fitment application means, said duct means being evacuated to hold said cap portion of said fitments against said fitment application means during a second portion of said timing cycle.

7. The apparatus-as defined in claim 3, wherein said carton advancing means comprises an indexing conveyor which carries each of said cartons to said fitment application station and then halts when each said cartons arrives at said fitment application station, said indexing conveyor being held stationary as said fitment application means presses each of said fitments against each of said cartons.

8. The apparatus as defined in claim 1, wherein said fitment supply means comprises a vibratory fitment feeder hopper and a gravity-feed bar conveyor for trans-porting said fitments from said fitment feeder hopper to said hot melt adhesive application means.

9. The apparatus as defined in claim 1, wherein said hot melt adhesive material is pressure sensitive.

10. The apparatus as defined in claim 1, wherein said fitment application means comprises a recess for receiving said cap portion of said fitments retained in said fitment retaining means, and further comprising suction means for applying a suction force to said cap portion for holding said fitment in abutting relationship with said fitment application means during movement of said fitment application means toward said closed top end of said carton standing at said fitment application station.

11. The apparatus as defined in claim 10, further comprising releasing means for blowing air toward said cap portion of said fitment to cause separation of said fitments from said fitment application means during said retraction of said fitment application means away from said closed top end of said cartons standing at said fitment application station.

12. The apparatus as defined in claim 11, wherein said suction means comprises a reversible blower in a first state and said releasing means comprises said reversible blower in a second state, said reversible blower blowing air in a predetermined direction in said first state and in a direction opposite to said predetermined direction in said second state.

13. The apparatus as defined in claim 1, wherein said hot melt adhesive application means comprises a reservoir of hot melt adhesive material, a hot melt distribution roll partially immersed in said reservoir and a hot melt applicator roll in rolling contact with said hot melt distribution roll and said flange portion of a fitment at a predetermined locus along said guideway.

14. An apparatus for producing a formed, filled, and sealed liquid container from a carton blank having a die-cut spout hole and a spout fitment having a flange, comprising:

means for forming said carton blank into a formed container having a closed bottom and having said die-cut spout hole sealed by an extrusion layer of extruded thermoplastic material applied over said spout hole on an external surface of said container;

means for filling said formed container with pourable matter through an open top end thereof to produce a filled container;

means for sealing said filled container closed by closing said top end thereof; and means for attaching said spout fitment on said layer of extruded thermoplastic material in registration with said spout hole, wherein said forming means, said filling means, said sealing means and said spout fitment attaching means are arranged at sequential stations in the recited order along a continuous production line.

15. The apparatus as defined in claim 14, wherein said spout fitment attaching means comprises:

hot melt adhesive application means for applying hot melt adhesive material on a bottom surface of said spout fitment flange; and fitment application means for positioning said fitment in registration with said spout hole and pressing said adhesive-coated bottom surface of said spout fitment flange against said layer of extruded thermoplastic material, whereby said fitment is sealed to said container.

16. A method for producing a formed, filled, and sealed liquid container from a carton blank having a die-cut spout hole and a spout fitment having a flange, comprising the steps of:

forming said carton blank into a container having a closed bottom and having the die-cut spout hole sealed by an extrusion of extruded thermoplastic material applied over said spout hole on an external surface of said container;

filling said container with pourable matter through an open top end thereof;

sealing said filled container closed by closing said top end thereof; and attaching a spout fitment on said layer of extruded thermoplastic material in registration with said spout hole, wherein said steps of forming, filling, sealing and attaching said spout fitment are performed in sequence in the recited order at respective stations along a continuous production line.

17. The method as defined in claim 16, wherein said spout fitment attaching step comprises applying hot melt adhesive material to the bottom surface of said flange of said spout fitment and then pressing said bottom surface against said layer of extruded thermoplastic material in registration with said spout hole.

18. The method as defined in claim 17, wherein said hot melt adhesive material is pressure sensitive.

* * * * *